US006293257B1

(12) United States Patent
Kawasaki

(10) Patent No.: US 6,293,257 B1
(45) Date of Patent: Sep. 25, 2001

(54) FUEL SUPPLY SYSTEM MOUNTING STRUCTURE FOR AN OUTBOARD MOTOR

(75) Inventor: Naoki Kawasaki, Hamamatsu (JP)

(73) Assignee: Suzuki Motor Corporation, Hamamatsu (JP)

( * ) Notice: Subject to any disclaimer, the term of this patent is extended or adjusted under 35 U.S.C. 154(b) by 0 days.

(21) Appl. No.: 09/531,538

(22) Filed: Mar. 20, 2000

(30) Foreign Application Priority Data

Mar. 18, 1999 (JP) ..... 11-074389

(51) Int. Cl.[7] ..... F02M 33/04
(52) U.S. Cl. ..... 123/509; 123/195 P
(58) Field of Search ..... 123/509, 510, 123/195 P; 440/900

(56) References Cited

U.S. PATENT DOCUMENTS 5,669,358 * 9/1997 Osakabe ..... 123/509
5,724,936 * 3/1998 Osakabe ..... 123/195 P
5,803,036 * 9/1998 Takahashi et al. ..... 123/195 P
5,943,996 * 8/1999 Sagawa et al. ..... 123/195 P
5,980,341 * 11/1999 Mishima et al. ..... 123/195 P
6,070,564 * 6/2000 Hiraoka et al. ..... 123/509

FOREIGN PATENT DOCUMENTS 10-176541 A 6/1998 (JP) .

* cited by examiner

*Primary Examiner*—Thomas N. Moulis
(74) *Attorney, Agent, or Firm*—Finnegan, Henderson, Farabow, Garrett & Dunner, L.L.P.

(57) ABSTRACT

The present invention disposes a fuel pump and a fuel filter in an efficient layout for compact construction of the components around the engine, while improving the convenience of a fuel hose piping that connects between the fuel pump and the fuel filter, in an outboard motor equipped with a four-cycle engine. An embodiment of the present invention provides an outboard motor having a four-cycle engine installed therein in the longitudinal direction with a crank shaft thereof disposed vertically, a fuel pump 26 is mounted on one side face of a cylinder head 6 of the engine 2, and a fuel filter 27 is mounted on the opposite side face. Fuel hose joints 26*a* and 27*a* of the fuel pump 26 and of the fuel filter 27 are installed in a direction toward the head cover 7 side of the engine 2.

5 Claims, 5 Drawing Sheets

FUEL SUPPLY SYSTEM MOUNTING STRUCTURE FOR AN OUTBOARD MOTOR

BACKGROUND OF THE INVENTION

1. Field of the Invention

The present invention relates to a fuel supply system mounting structure for supplying fuel to an engine of an outboard motor.

2. Description of the Related Art

In an outboard motor in general, an engine is installed in the longitudinal direction so that a crankshaft is disposed vertically, while a drive shaft linked to the lower end of the crank shaft so as to be rotatable in unison extends downward thereby to drive a screw propeller to rotate. The engine is enclosed by an engine cover for protection against water, while fuel supply devices such as a fuel pump and a fuel filter are installed around the engine.

Four-cycle engines have been used predominantly instead of 2-cycle engines for outboard motor engines in recent years in consideration of environmental conservation. However, given the same engine displacement, a four-cycle engine tends to be larger than a 2-cycle engine, though the engine cover cannot be made large enough for reasons of appearance and the need to avoid deteriorating aerodynamic performance. As a consequence, in an outboard motor equipped with a four-cycle engine, there remains only a small space between the engine and the engine cover that makes it difficult to install such devices as a fuel pump and a fuel filter.

SUMMARY OF THE INVENTION

The advantages and purposes of the invention will be set forth in part in the description which follows, and in part will be obvious from the description, or may be learned by practice of the invention. Moreover, the advantages and purposes of the invention will be realized and attained by means of the elements and combinations particularly pointed out in the appended claims.

The present invention claims to solve the problems described above, and it is an object of the present invention to provide a fuel supply system mounting structure for an outboard motor equipped with a four-cycle engine that makes it possible to dispose the fuel pump and the fuel filter in an efficient layout for compact construction of the components around the engine, while improving the convenience of a fuel hose piping that connects between the fuel pump and the fuel filter.

In order to achieve the object described above, in a fuel supply system mounting structure for an outboard motor, according to an exemplary embodiment of the present invention, having a four-cycle engine installed therein in the longitudinal direction with a crank shaft thereof disposed vertically, a fuel pump is mounted on one side face of a cylinder head of the engine, and a fuel filter is mounted on the opposite side face. Fuel hose joints of the fuel pump and the fuel filter are directed to a head cover side of the engine.

Also, in the fuel supply system mounting structure for the outboard motor, according to another exemplary embodiment of the present invention, having a four-cycle engine installed therein in the longitudinal direction with a crank shaft thereof disposed vertically, a fuel pump and a fuel filter are mounted on one side face of a cylinder head of the engine. Also, the fuel pump and the fuel filter are disposed in a longitudinal direction with the fuel hose joints of the fuel pump and the fuel filter being directed in the same direction.

By disposing the fuel pump and the fuel filter on opposite side faces of the cylinder head or in the longitudinal direction on one side face of the cylinder head, as described above, the fuel pump and the fuel filter are prevented from protruding significantly from the engine in the longitudinal and/or lateral direction because the fuel pump and the fuel filter can be contained in a kind of dead space produced between the cylinder head and an intake passage and an exhaust passage that protrudes from the side face of the cylinder head, thus making the construction around the engine compact.

Also, by directing the fuel hose joints of the fuel pump and the fuel filter, that are installed on the opposite side faces of the cylinder head, to the head cover side or making the fuel hose joints of the fuel pump and the fuel filter that are installed on the one side faces of the cylinder head in longitudinal direction, pointed in the same direction, the fuel hose that connects the fuel pump and the fuel filter can be made shorter thereby improving the convenience of the fuel hose piping.

The above and other objects, features and advantages of the present invention will become apparent from the following description of a preferred embodiment taken in conjunction with the accompanying drawings.

BRIEF DESCRIPTION OF THE DRAWINGS

The accompanying drawings are included to provide a further understanding of the invention and are incorporated in and constitute a part of this specification. The drawings illustrate embodiments of the invention and, together with the description, serve to explain the principles of the invention. In the drawings.

DESCRIPTION OF THE PREFERRED EMBODIMENTS

Reference will now be made in detail to the present preferred embodiments of the invention illustrated in the accompanying drawings. Wherever possible, the same reference numbers are used throughout the drawings to refer to the same or like parts.

Figure 1:
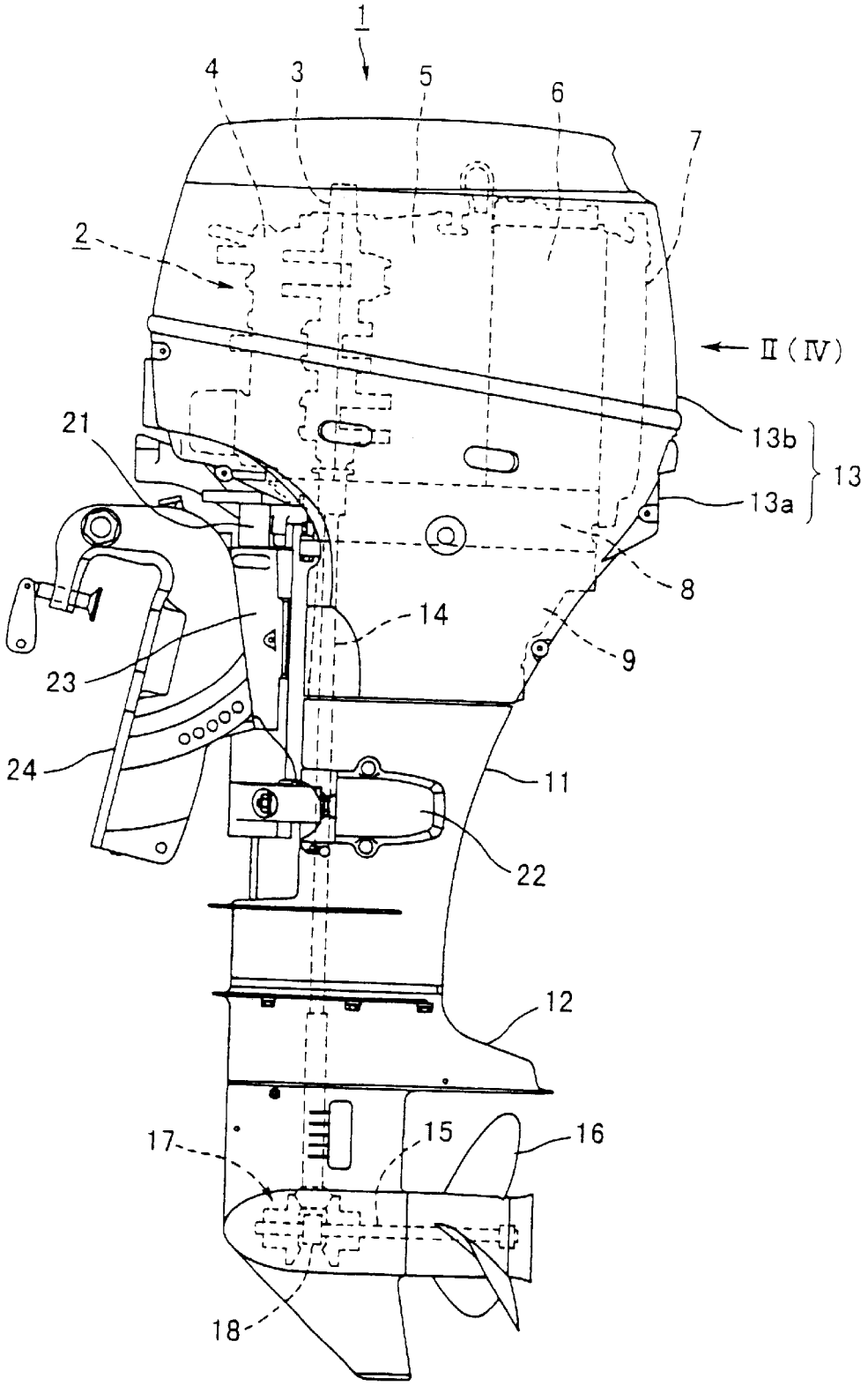
FIG. 1 is a left side elevational view of an outboard motor to which an embodiment of fuel supply system mounting structure of the present invention is applied.

As illustrated in FIG. 1, an engine 2 installed at the top of the outboard motor 1 comprises, for example, a four-cycle engine having three cylinders arranged in line and is secured on an engine holder 8 of a flat plate configuration in a longitudinal direction so that a crank shaft 3 thereof is disposed vertically and a crank case 4, a cylinder block 5, a cylinder head 6 and a head cover 7 are arranged in this order from the front. An oil pan 9 is secured on the bottom surface of the engine holder 8, while a drive housing 11 and a gear housing 12 are secured in this order on the bottom of the oil pan 9.

The engine 2, the engine holder 8, and the oil pan 9 are enclosed by an engine cover 13 that can be separated into upper and lower parts, to be waterproof. The engine cover 13 consists of a lower cover 13*a* secured onto the engine holder 8 and the oil pan 9, and an upper cover 13*b* attached detachably thereon, so that the upper cover 13*b* is removed in the case of servicing the engine 2 or the like.

A drive shaft 14 is linked to the lower end of the crank shaft 3 of the engine 2 to be rotatable in unison with the drive shaft 14 extending downward through the engine holder 8, the oil pan 9, and the drive housing 11, so as to reach the inside of the gear housing 12. Installed in the gear housing 12 is a propeller shaft 15 supported in a lRi horizontal (longitudinal) direction, with a screw propeller 16 mounted on the rear end thereof to rotate in unison.

In a portion where the drive shaft 14 crosses the propeller shaft 15, a bevel gear mechanism 17 and a clutch shifter 18 are provided, while rotation of the drive shaft 14 is transmitted to the propeller shaft 15 via the bevel mechanism 17, to cause the screw propeller 16 to rotate and produce propulsion force. Also, the clutch shifter 18 switches the rotation of the propeller shaft 15, forward or reverse, which is driven by the drive shaft 14 that always rotates in a fixed direction, thereby selecting forward or reverse movement of the outboard motor 1 (boat).

Secured on mounts 21 and 22 that are installed on the front edges of the engine holder 8 and the drive housing 11, respectively, are an upper end and lower end of a swivel shaft 23, while the swivel shaft 23 is supported by a clamp bracket 24 to be freely rotatable clockwise or counterclockwise, with the clamp bracket 24 being secured on the stern of the hull. The outboard motor 1 is steered by turning the swivel shaft 23 about the axis thereof to the left or right.

Figure 2:
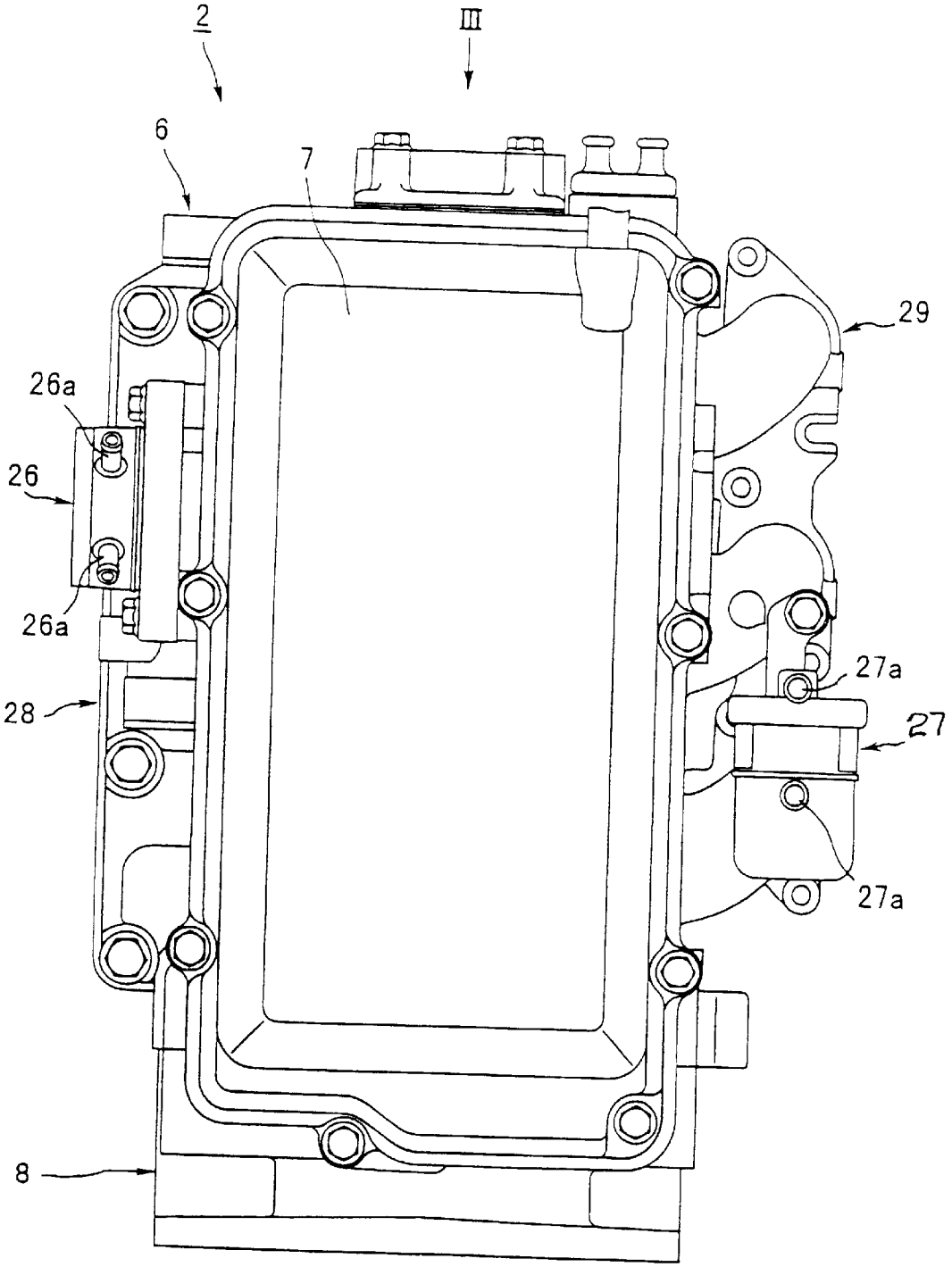
FIG. 2 shows the first embodiment of the present invention along line II.
Figure 3:
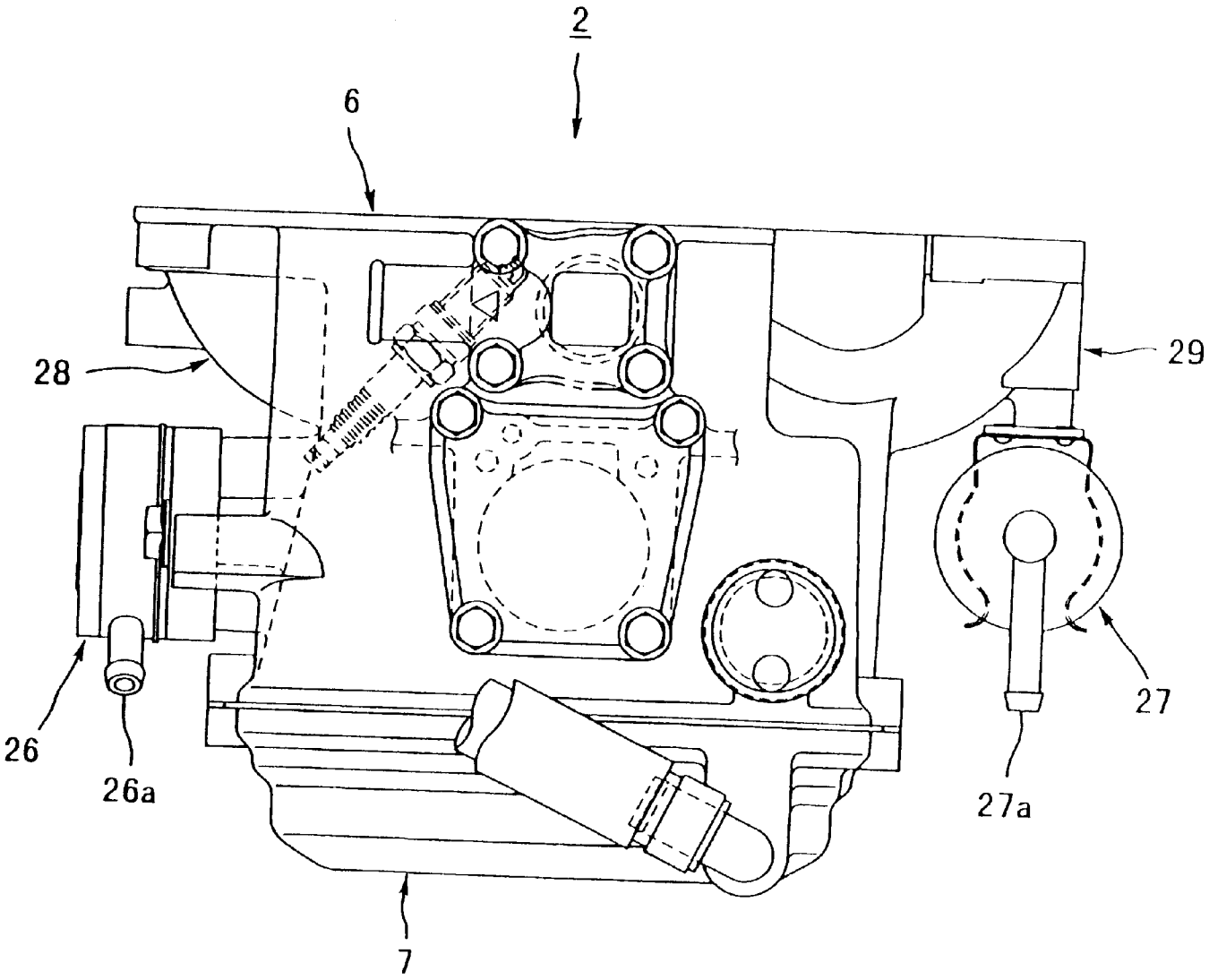
FIG. 3 is a plan view along line III in FIG. 2.

FIG. 2 is a rear view of the engine 2 along line 11 of FIG. 1, and FIG. 3 is a plan view along line III of FIG. 2. These drawings show the first embodiment of the fuel supply system mounting structure according to the present invention. The fuel supply system is constituted from the fuel pump 26 and the fuel filter 27.

In the first embodiment, the fuel pump 26 is installed on one side face (for example, the left side face) of the cylinder head 6, and the fuel filter 27 is installed on the opposite side face (for example, the right side face). Installed on the left side face of the cylinder head 6 to protrude therefrom is an exhaust passage 28, while an intake passage 29 is installed on the right side face to protrude therefrom. The fuel pump 26 and the fuel filter 27 are installed adjacent behind (head cover 7 side) the exhaust passage 28 and the intake passage 29. Fuel house joints 26*a* and 27*a* of the fuel pump 26 and the fuel filter 27 are pointed toward the head cover 7 side.

When the fuel pump 26 and the fuel filter 27 are installed on the opposite side faces of the cylinder head 6, as described above, the fuel pump 26 and the fuel filter 27 are prevented from protruding significantly in the longitudinal and/or lateral directions from the engine 2 because the fuel pump 26 and the fuel filter 27 can be contained in a kind of dead space produced between the cylinder head 6 and the intake passage 29 and the exhaust passage 28, thus making the construction around the engine 2 compact.

Consequently, even when the engine 2 is large in size due to four-cycle operation as in the case of the outboard motor 1, the engine 2 can be enclosed without increasing the size of the engine cover 13 significantly while maintaining satisfactory appearance and aerodynamic performance of the outboard motor 1.

Moreover, by making the fuel hose joints 26*a* and 27*a* of the fuel pump 26 and the fuel filter 27 pointed toward the head cover 7 side, the fuel hose (not shown), which connects the fuel hose joints 26*a* and 27*a*, can be made shorter, thereby improving the convenience of the fuel hose piping. The fuel hose that connects the fuel hose joints 26*a* and 27*a* is installed to run behind the head cover 7.

Figure 4:
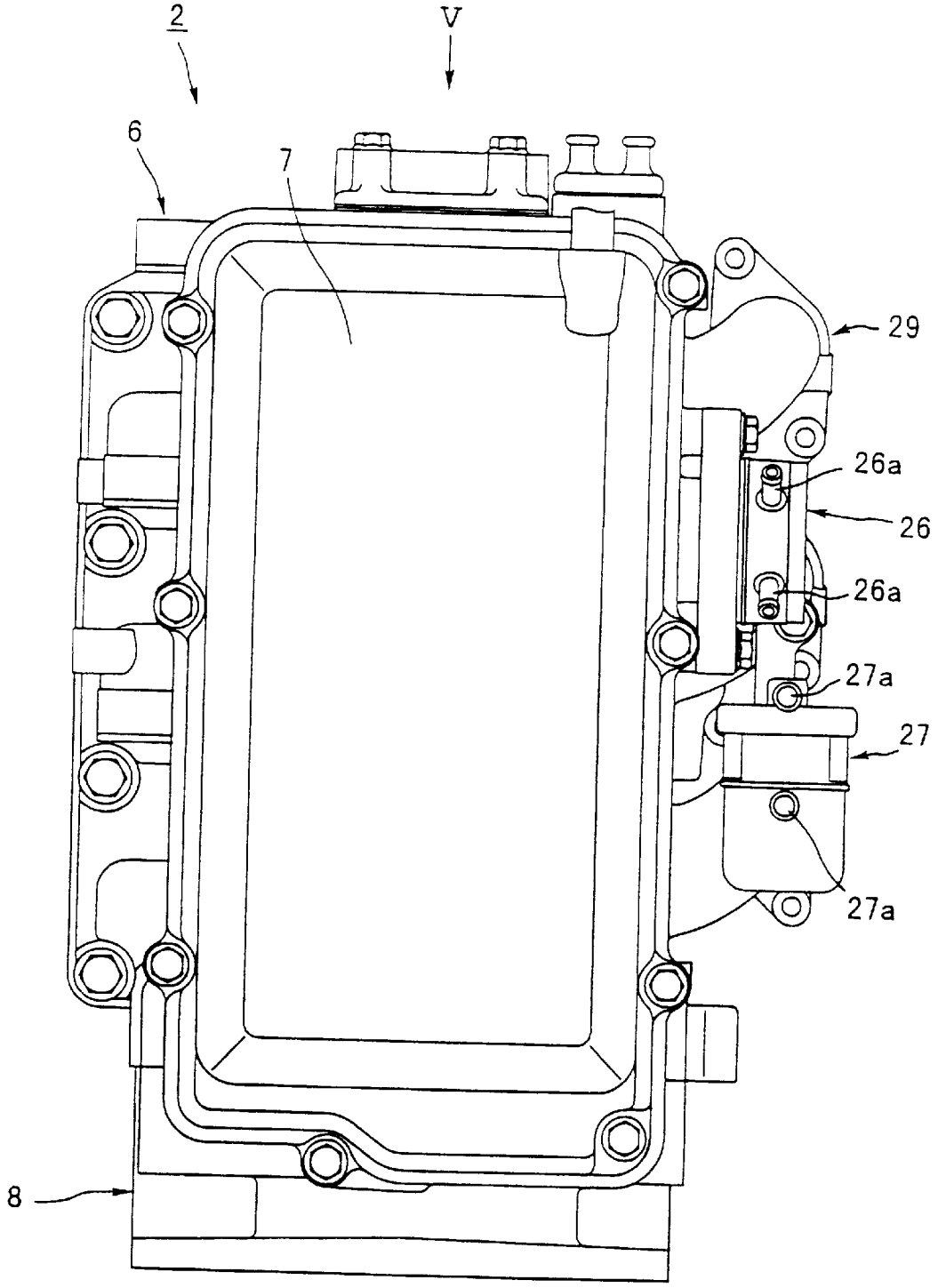
FIG. 4 shows the second embodiment of the present invention along line IV in FIG. 1.
Figure 5:
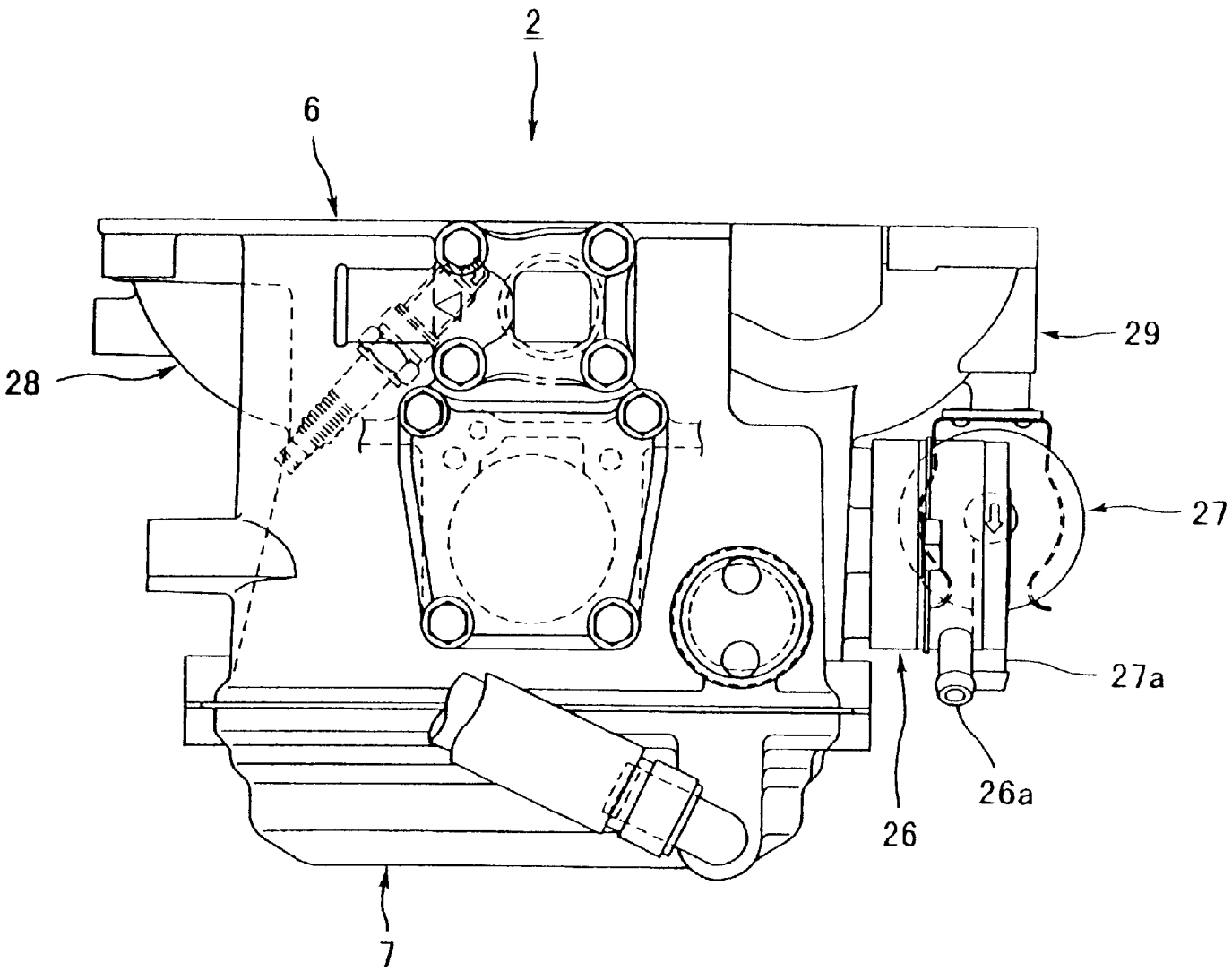
FIG. 5 is a plan view along line IV in FIG. 4.

FIG. 4 is a rear view of the engine 2 of line IV in FIG. 1, and FIG. 5 is a plan view along line V in FIG. 4. These drawings show the second embodiment of the fuel supply system mounting structure according to the present invention.

In the second embodiment, the fuel pump 26 and the fuel filter 27 are installed together on the same side face (for example, the right side face) of the cylinder head 6. The fuel pump 26 and the fuel filter 27 are installed to run adjacent in the longitudinal direction behind (head cover 7 side) the intake passage 29 that is installed on the cylinder head 6 to protrude therefrom, while the fuel filter 27 is located below the fuel pump 26. The fuel hose joints 26*a* and 27*a* of the fuel pump 26 and the fuel filter 27 are directed in the same direction, for example, rearward.

When the fuel pump 26 and the fuel filter 27 are installed in the longitudinal direction on one side face of the cylinder head 6, as described above, the fuel pump 26 and the fuel filter 27 can be contained compactly in a kind of dead space produced between the cylinder head 6 and the intake passage 29, similar to the first embodiment. In this case, since other auxiliary devices can be installed on the other side face of the cylinder head 6, construction around the engine 2 can be made more effectively compact.

Also, because the fuel hose joints 26*a* and 27*a* of the fuel pump 26 and the fuel filter 27 are pointed in the same direction, the fuel hose that is connected to the fuel hose joints 26*a* and 27*a* can be made shorter similar to the first embodiment.

A number of modifications may be made to the second embodiment of the present invention. For example, the installation position of the fuel pump 26 and the fuel filter 27 may be changed from the right side face of the cylinder head 6 to the left side face of the cylinder head 6. Additionally, the vertical positional relationship between the fuel pump 26 and the fuel filter 27 may be reversed.

In the fuel supply system mounting structure of the outboard motor, according to the present invention, as described above, as the fuel pump and the fuel filter are installed by effectively utilizing the dead space around the engine, the fuel pump and the fuel filter can be prevented from protruding significantly in the longitudinal and/or lateral direction from the engine. Moreover, construction around the engine can be made compact and the convenience of the fuel hose piping that connects between the fuel pump and the fuel filter can be improved.

Other embodiments of the invention will be apparent to those skilled in the art from consideration of the specification and practice of the invention disclosed herein. It is intended that the specification and examples be considered as exemplary only. Thus, it should be understood that the invention is not limited to the illustrative examples in this specification. Rather, the invention is intended to cover all modifications and variations that come within the scope of the following claims and their equivalents.

What is claimed is:

1. A fuel supply system mounting structure for an outboard motor comprising:

a four-cycle engine installed within an engine cover along a longitudinal direction and having a crank shaft disposed vertically and a cylinder head having a first side face and second side face opposite to the first side face;

a fuel pump mounted on the first side face of the cylinder head of the engine; and a fuel filter mounted on second side face.

2. A fuel supply system mounting structure for an outboard motor according to claim 1, further comprising fuel hose joints and in communication with said fuel pump and said fuel filter so as to be directed to a head cover side of said engine.

3. A fuel supply system mounting structure for an outboard motor comprising:

a four-cycle engine installed within an engine cover along a longitudinal direction and having a crank shaft disposed vertically and a cylinder head having a side face; and a fuel pump and a fuel filter mounted on the side face of the cylinder head of said engine.

4. A fuel supply system mounting structure for an outboard motor according to claim 3, wherein said fuel pump and said fuel filter are disposed in the longitudinal direction.

5. A fuel supply system mounting structure for an outboard motor according to claim 4, further comprising first and second fuel hose joints in communication with said fuel pump and said fuel filter and arranged so as to point in the same direction.

* * * * *